US006073825A

United States Patent [19]

Hilker

[11] Patent Number: 6,073,825

[45] Date of Patent: Jun. 13, 2000

[54] DIRECTIONAL TAIL TRANSFER THREADING APPARATUS

[75] Inventor: Dieter H. Hilker, Mascouche Heights, Canada

[73] Assignee: Paprima Industries Inc., Lachine, Canada

[21] Appl. No.: 09/198,262

[22] Filed: Nov. 24, 1998

[30] Foreign Application Priority Data

Nov. 18, 1998 [CA] Canada ..... 2254319

[51] Int. Cl.[7] ..... G03B 1/56; D21F 1/36; B65H 20/14

[52] U.S. Cl. ..... 226/91; 162/193; 226/7; 226/97.1; 242/615.21

[58] Field of Search ..... 226/91, 92, 97.1, 226/7; 242/615.11, 615.21; 162/193

[56] References Cited

U.S. PATENT DOCUMENTS 3,999,696 12/1976 Reba et al. .
4,014,487 3/1977 Reba et al. .
4,136,808 1/1979 Reba .
4,186,860 2/1980 Reba .
4,342,413 8/1982 Reba ..... 226/7 X
4,501,643 2/1985 Kiuru ..... 162/193 X
4,688,784 8/1987 Wirz ..... 226/97.1 X
4,726,502 2/1988 Cryderman .
4,763,822 8/1988 Mohrsen .
4,904,344 2/1990 Peiffer ..... 162/193
5,738,760 4/1998 Svanqvist et al. .

*Primary Examiner*—Michael R. Mansen

[57] ABSTRACT

A directional tail transfer apparatus includes a tray that defines a longitudinal path line extending along the tray overwhich a paper tail to be threaded travels. The longitudinal path line of the tray is positioned adjacent a first section in a papermaking machine where the paper tail exits. The longitudinal path line is aligned with the initial path of movement of the paper tail. The tray has with one or more creases, which extend across the tray width and bisect the longitudinal path line to effect a natural change in direction of the longitudinal path line through the tray. At least one of the creases bisects the longitudinal path line at predetermined angles other than 90 degrees to provide a lateral displacement in the portion of the tray that follows this crease. This one crease allows the paper tail to fold along its width on an angle that is not perpendicular to the natural downstream path of travel of paper tail. As a result the paper tail changes direction to follow the tray along the longitudinal path line. The fold angle of the creases and lengths of the tray portions pre-selected to accurately deliver the paper tail to a threading nip. The tray further includes an air or gaseous flow source for directing an air-cushioning stream over the tray to pull or draw the paper tail over and along the tray surfaces. The tray is operable at all angles of installation, including an inverted position.

46 Claims, 7 Drawing Sheets

DIRECTIONAL TAIL TRANSFER THREADING APPARATUS

FIELD OF THE INVENTION

The present invention relates to a directional tail transfer apparatus for directing a tail of a web of flexible material into a threading nip of a machine where the tail is directed laterally from its initial path of movement. In particular, the present invention relates to a directional paper tail transfer apparatus for use in papermaking machines.

BACKGROUND OF THE INVENTION

In the manufacture of paper, plastic film or similar materials, highly undesirable web breakage occasionally occurs during machine operation and also at machine start-up. The web breakage is highly undesirable because the web has to be rethreaded prior to continuing manufacture. This can result in manufacturing delays. Web breakage in papermaking machines is even more undesirable because of the continuous running operation of these machines. In high-speed papermaking machines the paper continually moves through the machine at speeds up to 2000 meters/minute (m/min). Consequently, it is important for the rethreading of the web to be performed quickly and properly to reduce web wastage.

In practice, after a paper break, the web is threaded in stages through the papermaking machine by cutting a tail and threading the tail through the machine. Any part of this threading process that can be automated is advantageous because it reduces downtime associated with web breakage. The term tail refers to an edge piece cut into the traveling web by means of a cut into the web from the edge of the web and a continuous slit along the web which forms the "tail" or "edge piece" or "leader" of the paper web. This leader or tail may be blown or directed into the next portion of the paper making machine at which time the remainder of the web is severed so that the tail pulls the web through the next portion of the machine to be threaded. Typically the tail is anywhere from 5 to 20 centimeters in width compared to the remainder of the width of the web which can be in the order of 7 meters.

The rethreading process in a papermaking machine usually involves threading the tail from a first section of the machine such as, for example, a dewatering nip in the former, dryer or calender stack into a threading nip located downstream of the first section of the machine. The threading nip commonly comprises a pair of ropes entrained about pulleys between which the paper is threaded. The ropes move at or near the paper speed to pull the paper tail and draw the tail into the next section of the papermaking machine. The threading nip is normally located laterally offset from the normal through machine path of travel of the paper web so as not to interfere with the normal operation of the machine. However, the laterally offset positioning of the nip presents a major problem to rethreading a tail after web breakage. It is very difficult to laterally shift a tail of 5 to 20 centimeters in width moving at high speeds over runs of 0.5 to 6.5 meters consistently without twisting or folding the paper and thereby adversely effecting the planar integrity of the paper.

U.S. Pat. No. 4,136,808 issued Jan. 30, 1979 to Imants Reba discloses a web threading system for directing a paper tail laterally from one section of a papermaking machine and into threading nip ropes in a papermaking machine. The web threading system discloses redirection of the paper tail by the use of two Coanda nozzles angled relative to each other so that the paper tail changes direction as it passes over the nozzles. The nozzles direct the air stream or gas over two walls, or tray floors, which have two opposing upstanding sidewalls. The sidewalls redirect the air stream, tending to flow off the floor wall back over the floor wall. The paper tail, in theory, travels with the airflow over the floor walls; however, in practice the side walls are necessary to prevent the paper tail from falling over the sides of the floor wall. FIG. 1 of this patent has a first wall hinged relative to the second wall to redirect the paper tail up and into a threading nip. There is a lateral angular displacement shown in FIG. 2 between the first and second walls, which are angled relative to each other based on a radius formula. The first and second walls, however, are formed of two separate non-uniform separate tray structures that if laid flat do not provide a uniform structure. In practice, the disclosed web tray threading system does not provide a natural path of least resistance along which the paper follows into the threading nip. Consequently, the accuracy for determining the precise delivery location of the paper tail into the threading nip from this system cannot be predetermined with consistency. Further, the condition of the paper tail, that is its planar integrity, is most likely adversely affected because the paper does not move in a path of least resistance or one that seems natural for the paper tail to follow. The inaccuracy and inconsistency of the delivery of the paper tail into the threading nip is further affected by varying the web weight, moisture content and speed.

SUMMARY OF THE INVENTION

It is a feature of the present invention to provide a directional tail transfer apparatus for directing a tail of a web of flexible material from a first section of a machine to a laterally offset threading nip where the tail follows a more natural path of travel.

It is another feature of the present invention to provide a directional tail transfer apparatus for directing a tail of a web of flexible material from a first section of a machine to a laterally offset threading nip of the machine where planar integrity of the tail is maintained so that the tail can be inserted into the threading nip without folds or creases developed by the paper traveling over the tray apparatus.

It is still yet another feature of the present invention to provide a directional tail transfer apparatus for directing a tail of a web of flexible material from a first section of a machine to a laterally offset threading nip of the machine where the apparatus can be adjusted to predetermined positions to accurately and consistently deliver the paper tail to the location of the threading nip.

These features of the present invention are provided by providing a directional tail transfer apparatus that includes a tray constructed to define a longitudinal path line extending therealong overwhich the paper tail travels. The longitudinal path line of the tray is positioned adjacent a first section in a machine where the paper tail exits and is aligned with the initial path of movement of the paper tail. The tray has one or more creases, which extend across the tray width and bisect the longitudinal path line to effect a natural change in direction of the longitudinal path line through the tray. At least one of the creases bisects the longitudinal path line at predetermined angles other than 90 degrees to provide a lateral displacement in the portion of the tray that follows this crease. This one crease allows the paper tail to fold along its width on an angle that is not perpendicular to the natural downstream path of travel of paper tail. As a result the paper tail changes direction to follow the tray along the longitudinal path line of the tray. The fold angles of the creases and lengths of the tray portions can be calculated to provide an adjustable tray that accurately delivers the paper tail to the threading nip. The tray further includes an air or gaseous flow source for directing an air-cushioning stream over the tray that pulls or draws the paper tail along the tray surfaces.

Throughout the specification and claims reference is made to the tray having creases. It should be understood that the purpose of the crease it to provide a location where different portions of the tray may be folded relative to each other. While it is envisaged that the tray may be a single structure of sheet metal having folds, in practice the tray is made from a single piece of sheet metal cut at the locations of the creases and secured by hinges to permit the fold.

The tail may comprise a chopped tail having a leader or leading end that passes over a pre-adjusted tray for threading into the downstream threading nip. Alternatively, the tray may be positioned in a retracted non-directing position so that the leader of the tail passes over the tray without the tray initially redirecting the leader. Once the tail passes partially or completely over the adjustable tray, a pneumatic or hydraulic system operably attached to the tray is actuated to adjust or fold the tray about its creases into a predetermined position where the tail is captured and redirected into the downstream threading nip.

In accordance with one aspect of the present invention there is provided a directional tail transfer apparatus for directing a tail of a web of flexible material from a first section of a machine to a threading nip of the machine where the threading nip is laterally offset from the initial path of movement of the tail exiting the first section. The directional paper tray transfer apparatus includes a first air stream source and an adjustable tray. The first air stream source is located adjacent the first section for directing a first air stream in a first direction. The adjustable tray is positioned downstream of the first air stream source over and along which the first air stream flows to pull the tail in a predetermined path of travel along the tray. The tray has a lead-in surface portion and a trailing surface portion. The lead-in surface portion has a first end located adjacent the first air stream source for capturing the tail over the tray. The trailing surface portion is located downstream of the lead-in surface portion. A first crease extends completely across the tray. The trailing surface portion has a second end adjacent the threading nip and upstream therefrom for directing the tail into the threading nip. The adjustable tray is characterized by a longitudinal path line defined by, and along which, the predetermined path of travel of the tail extends between the first and second ends of the tray. The first crease bisects the longitudinal path line at a predetermined angle other than 90 degrees, and the longitudinal path line changes direction when the planar portions of the tray are adjusted relative to each other about the first crease for directional adjustment of the predetermined path of travel of the tail.

In accordance with one aspect of the present invention there is provided a directional tail transfer apparatus for directing a tail of a web of flexible material from a first section of a machine to a threading nip of the machine where the threading nip is laterally offset from the initial path of movement of the tail exiting the first section. The directional paper tray transfer apparatus includes:

a first air stream source located adjacent the first section for directing a first air stream in a direction that pulls the tail;

an adjustable tray positioned downstream of the first air stream source over and along which the air stream flows to pull the tail in a predetermined path of travel along the tray; the tray having:

(i) a lead-in surface portion having a first end located adjacent the first air stream source for capturing the tail over the tray;

(ii) an intermediate surface portion located downstream of the lead-in surface portion and separated therefrom by a first crease extending completely across the tray;

(iii) a trailing surface portion located downstream of the intermediate surface portion, and a second crease extending completely across the tray, the trailing surface portion having a second end adjacent the threading nip and upstream therefrom for directing the tail into the threading nip; and, (iv) a longitudinal path line defined by, and along which, the predetermined path of travel of the tail extends between the first and second ends of the tray, the first and second creases each bisecting the longitudinal path line where at least the first crease bisects the longitudinal path line at predetermined angles other than 90 degrees, and the longitudinal path line changing direction when the planar portions of the tray are adjusted relative to each other about the first and second creases to adjust changes in direction of the predetermined path of travel of the tail.

The tray lead-in surface portion, intermediate surface portion, and trailing surface portion are preferably substantially planar extending surfaces. These surfaces are also preferably dimpled to reduce friction between the paper tail and the tray. The creases may diverge from each other or may be generally parallel to each other so long as at least one of the creases bisects the longitudinal path line at an angle other than 90 degrees.

It is envisaged that the intermediate surface portion is adjusted relative to the lead-in surface portion about the first crease by a first pre-selected angle to introduce a first offset component to the longitudinal path line of the tray for directing the tail along the intermediate surface portion in a second direction parallel to the longitudinal path line in the intermediate surface portion. Further, the trailing surface portion is adjusted relative to the intermediate surface portion about the second crease by a second pre-selected angle to introduce a second offset component to the longitudinal path line of the paper tray to direct the tail along the trailing surface portion in a third direction parallel to the longitudinal path line in the trailing surface portion.

The first air stream is chosen to have a first velocity whose magnitude is greater than that of the velocity magnitude of the tail exiting the first section so as to draw or pull the paper tail in the direction of the air stream. The first air stream source may be a series of air flow nozzles extending in a direction perpendicular to the first direction of tail travel such that the first air stream pulls the tail along its width and maintains integrity of the tail.

The apparatus may include second and third air stream sources located respectively downstream of the first air stream source to direct air respectively over the intermediate surface portion and the trailing surface portion in directions parallel to the longitudinal path line extending along each of these portions.

BRIEF DESCRIPTION OF THE DRAWINGS

For a better understanding of the nature and objects of the present invention reference may be made to the accompanying diagrammatic drawings in which.

DETAILED DESCRIPTION OF THE DRAWINGS

Figure 1:
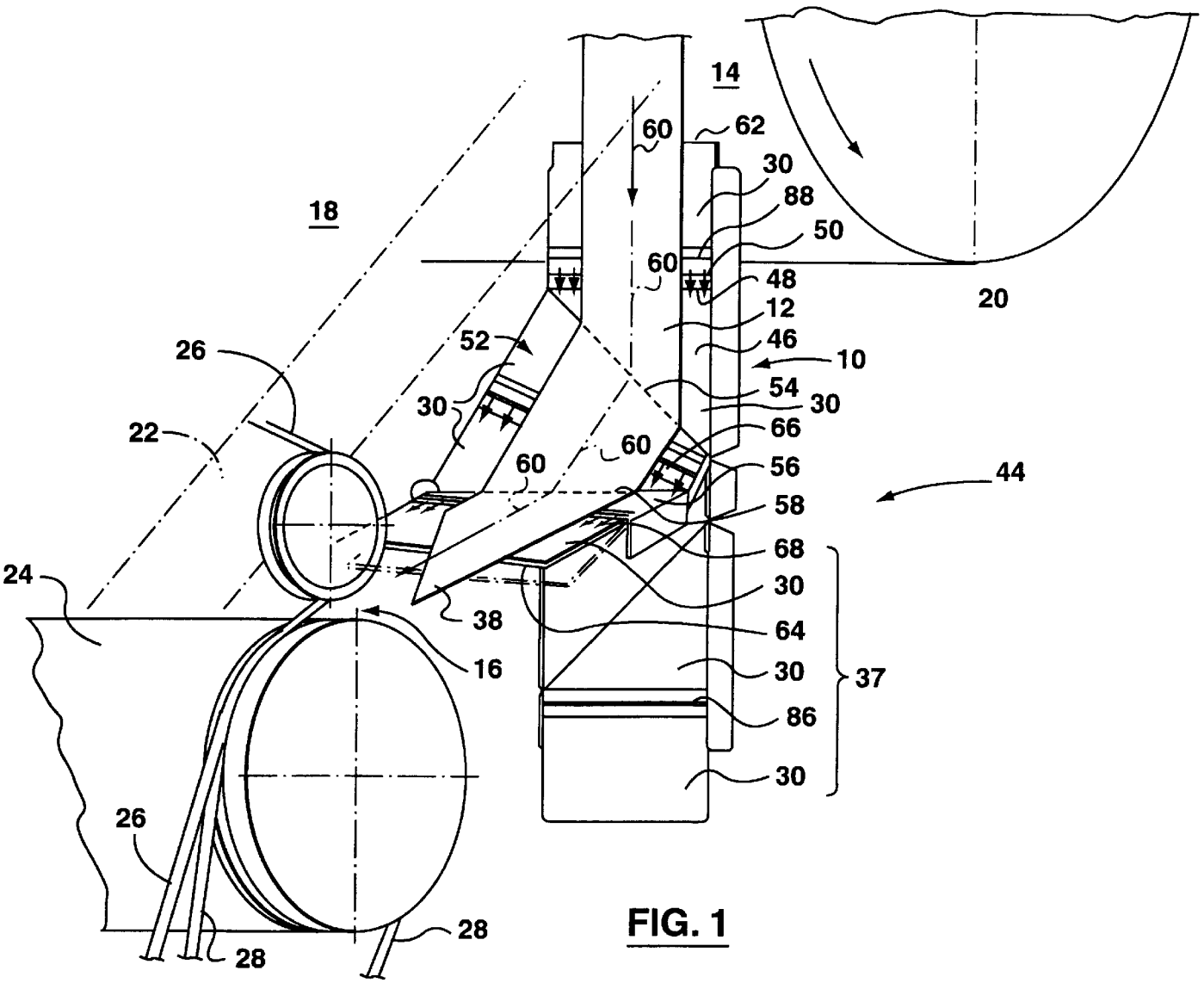
FIG. 1 is a perspective view showing the directional tail transfer apparatus of the present invention transferring a chopped tail in a papermaking machines.

Referring to FIG. 1 there is shown a directional tail transfer apparatus 10 for transferring a web of flexible material or a paper tail 12 from a dryer section 14 to a threading nip 16 of a papermaking machine 18. The dryer section 14 is shown to include a roll 20.

During normal papermaking operation, the web 22 (only a portion of which is shown in broken lines) travels from the dryer section 14 to the downstream support roll 24. It should be understood that the web 22 may be in the order of 3 to 10 meters in width. When a break in web 22 occurs upstream of, or in, the dryer section 14, tail cutters (not shown) cut a tail section 12 into the web 22. This tail 12 may be in the order of 10 to 20 centimeters in width and is usually located towards an outside edge of the roll 20.

Figure 2:
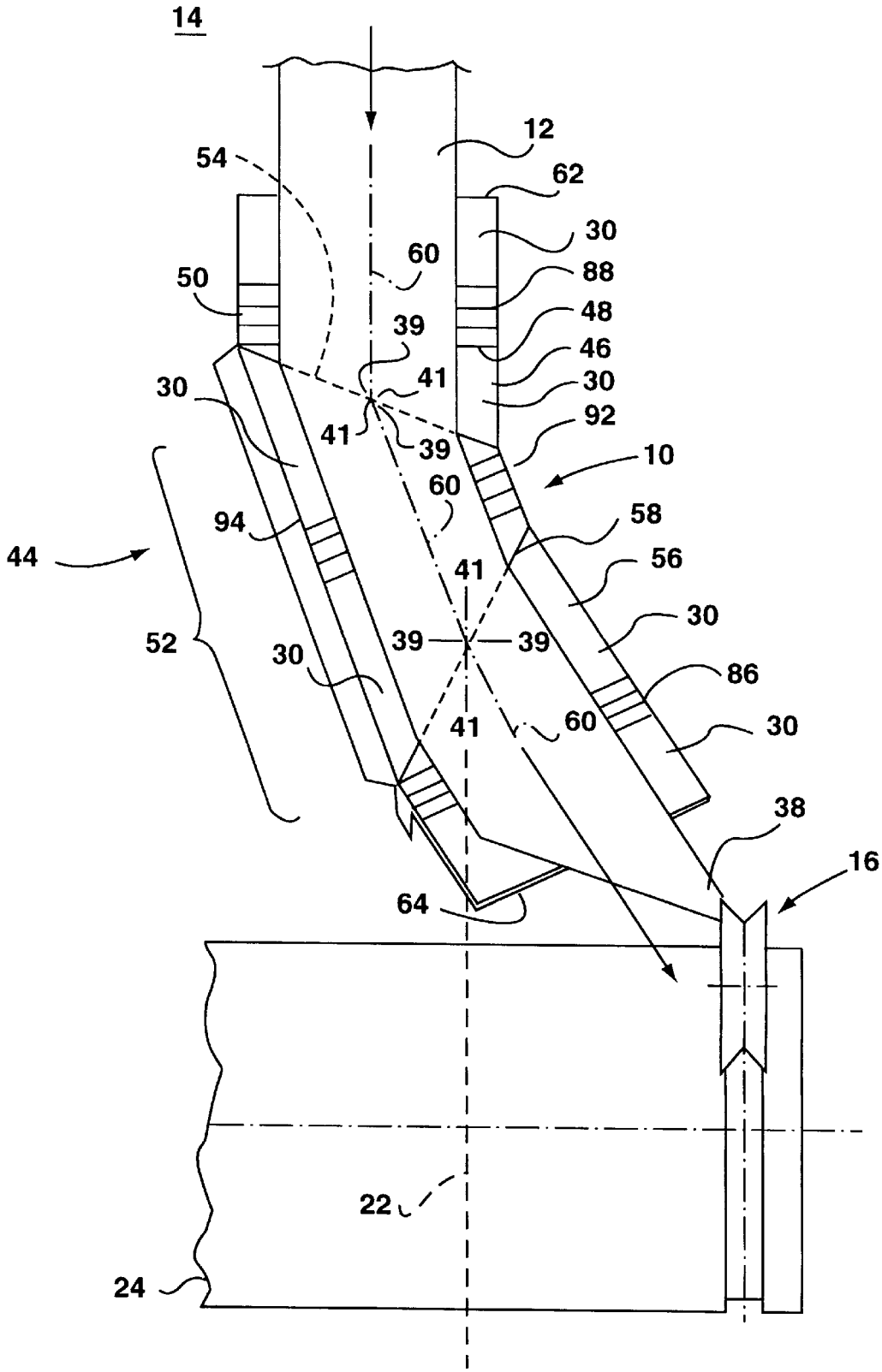
FIG. 2 is a plan view of the directional tray transfer apparatus shown in FIG. 1.
Figure 3:
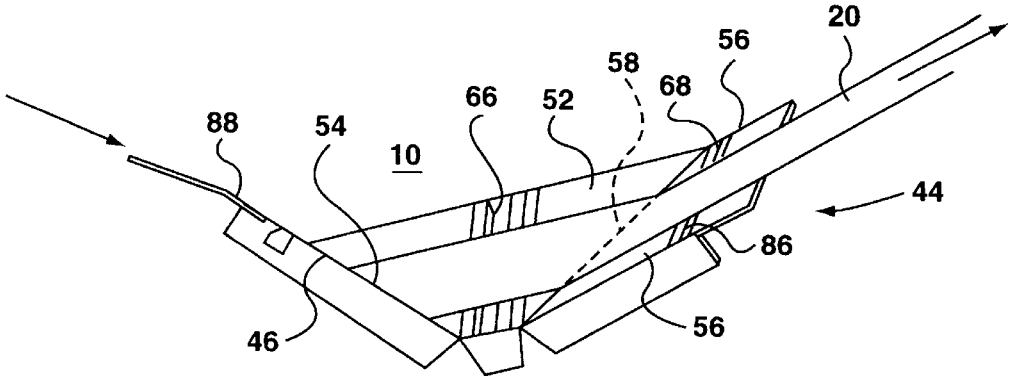
FIGS. 3 and 4 are side views taken of the tray shown in FIG. 1 where the FIG. 3 shows the tray in a generally upward position and FIG. 4 shows the tray in an inverted position.
Figure 4:
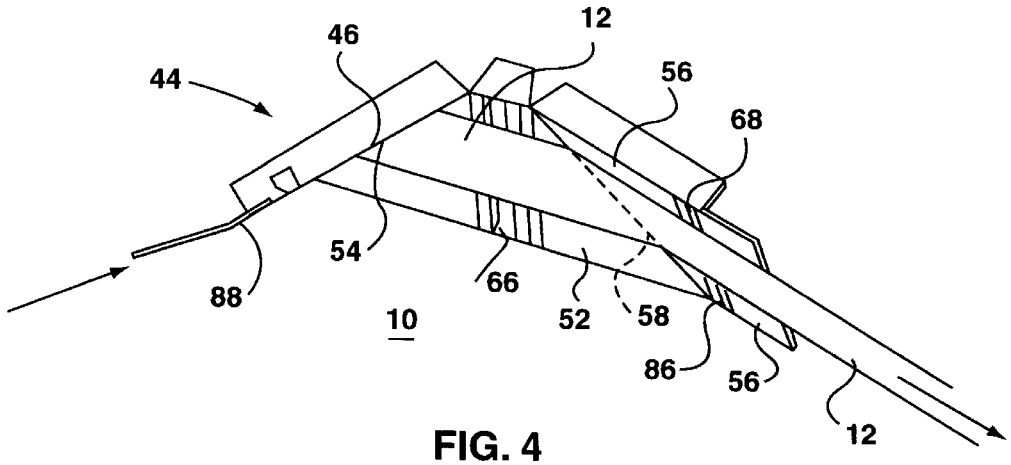
Figure 5:
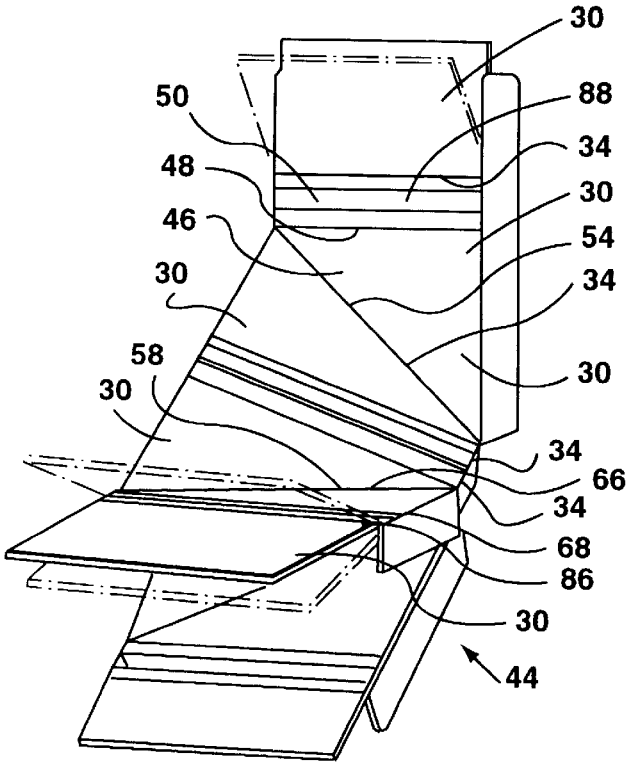
FIG. 5 is a perspective representation of the tray of FIG. 1 constructed in accordance with the present invention where the tray is illustrated in a folded position showing various positions of adjustment.

As best seen in FIG. 2, as the tail passes through the tail transfer apparatus 10, it is shifted laterally to the outside of the papermaking machine and into the threading nip 16 located between threading ropes 26 and 28. Once the tail 12 is captured by the ropes 26 and 28, the tail 12 is pulled tautly to follow a path similar to that of web 22. Generally, the threading ropes 26 and 28 are located laterally offset to the outside of the normal direction of paper travel. Consequently, the tail 12 must be directed laterally outward from the papermaking machine by the directional tail transfer apparatus 10.

Figure 6:
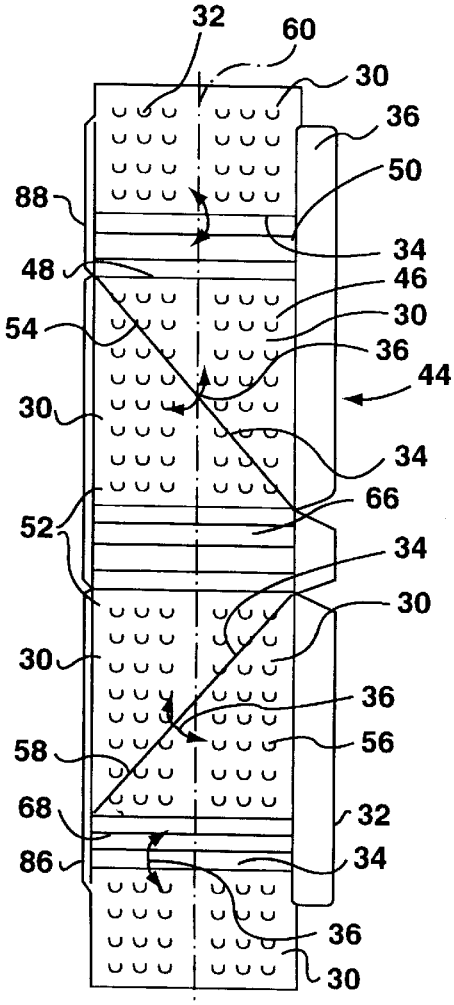
FIG. 6 is a front view of the tray of FIG. 5 shown a flat or retracted position.

Referring to FIGS. 1 through 6, the general construction of the directional paper tail transfer apparatus 10 of the present invention is described. The tray apparatus 10 is a generally rectangular shape when laid flat as shown in FIG. 6. The tray apparatus 10 is made by joining substantially flat or planar sheets 30 of metal together. The upper surface of the metal sheets 30 includes dimples 32 that reduce friction between tail 12 as it passes over sheets 30. The sheets 30 are adjustable or pivotally movable about hinged joints 34 as indicated by curved arrows 36. It should be understood that the sheets 30 located at opposing ends of the tray apparatus 10 provide for lead in and lead out surfaces that may not be necessary in all applications.

The sheets 30 of the tail transfer apparatus 10 provide the offset of the paper tail 12 from its initial path of travel by the introduction of novel folds between different functioning portions of the tray apparatus 10. The tray apparatus 10 includes an adjustable tray 44. The tray 44 is shown in FIG. 1 in an operational position and in a retracted position 37 by ghost lines. In the retracted position 37, the tray 44 is substantially flat and spaced out of the way of the web 22 during normal operation of the papermaking machine 18. In FIG. 1, the tray 44 may be adjusted by pneumatic operators to move the tray from the retracted position 37 and into the tail transfer position shown to capture the chopped leader 38 of the tail 12 and feed the leader 12 into the threading nip 16. Once captured by the threading nip, the tail is pulled off of the tray 44 and follows a path similar to that shown for the web 22 in broken lines. It should be understood that the pneumatics automatically orientate the tray 44 to the desired position. Alternatively, the tray 44 may already be placed in a preset position to transfer the tail 12.

The tray 44 has a lead-in planar surface portion 46 having a first end 48 located adjacent a first air stream generating means or source 50 of the tray apparatus 10. The tray 44 includes an intermediate planar surface portion 52 located downstream of lead-in planar portion 46. The intermediate portion 52 comprises one or, alternatively, two innermost sheets 30 and is separated from the lead-in portion 46 by a first crease 54 extending completely across the width of the tray 44. The tray 44 further includes a trailing planar surface portion 56 located downstream of the intermediate planar surface portion 52. The trailing portion 56 is separated from the intermediate surface portion 52 by a second crease 58 that extends completely across the width of the tray 44.

In FIG. 2 a longitudinal path line 60 is shown extending through the centerline of the tray 44. The arrows shown on the longitudinal path line 60 is defined by, or, alternatively, defines the directional path of travel of a paper tail 12 entering the tray 10 at the leading edge 62 and exiting the tray at the exit end 64. The tray 10 is positioned relative to the initial path of the paper tail travel exiting the roll 20 with the longitudinal path line 60 aligned to this initial path of paper tail travel. The first air stream source 50 directs a stream of air over the downstream sheets 30 which draws or pulls the paper tail 12 on an air cushion above the surfaces of sheets 30 of tray 44. The air stream also holds the tail 12 to the sheets 30 allowing the sheets 30 to be angled in any direction including the inverted orientation shown in FIG. 4. Any contact of the paper tail with the sheets 30 does not adversely influence the movement of the paper tail 12 over the sheets 30.

The tray apparatus 10 includes further air stream sources located mid way along the tray apparatus at 66 and further downstream at 68. The velocity of air or gas exiting the first air stream 50 is sufficient to capture the tail 12 and draw or pull it down from its initial path of travel over the leading edge 62 and lead-in planar portion 46. Thereafter, air stream sources 66 and 68 operate to draw or pull the tail over the succeeding sheets 30 located downstream of these sources. The magnitude of the velocity of air from each succeeding air flow source is greater than the preceding air flow source so as to continue to draw or pull the paper tail 12 over the sheets 30. The pulling effect of the air sources allows the paper tail to be forwarded over the folded creases 54 and 58 where the paper tail 12 is re-directed by the tray in a manner described hereafter. The air flow sources 50, 66 and 68 are supplied by hoses through fittings (not shown).

Figure 8:
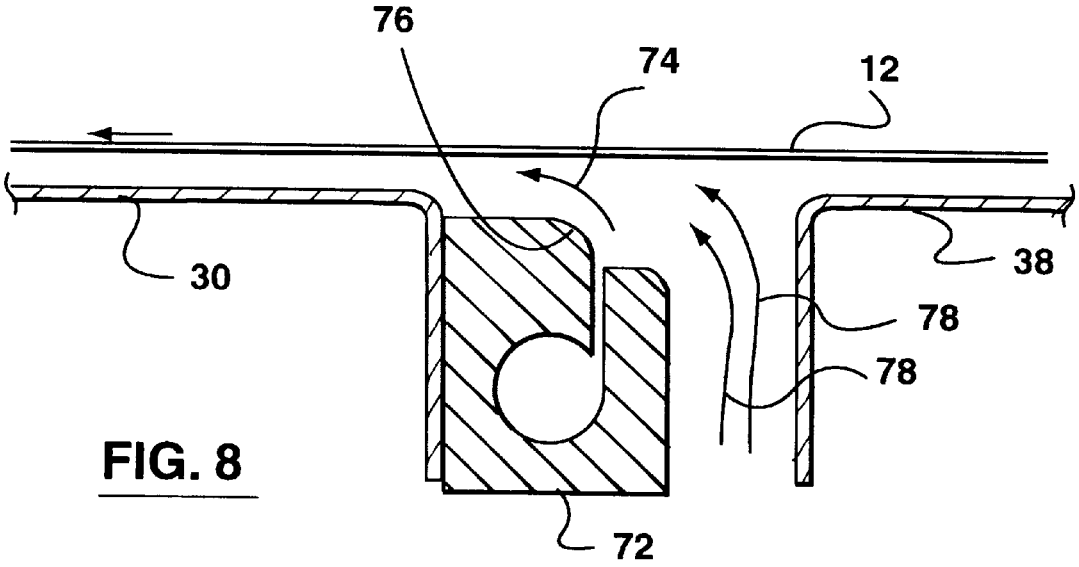
FIGS. 8 and 9 show two different types of air stream sources used in the present invention.

Referring to FIG. 8 one embodiment for the air flow sources 50, 66 and 68 is shown to comprise a jet nozzle for directing an air stream 74 over a surface 76 which draws entrained air over the curved surface 76 from gap 78. The nozzle extends the width of the tray 44 to direct air stream 74 in a direction parallel to the direction of paper tail travel 12 over the tray sections 30.

Figure 9:
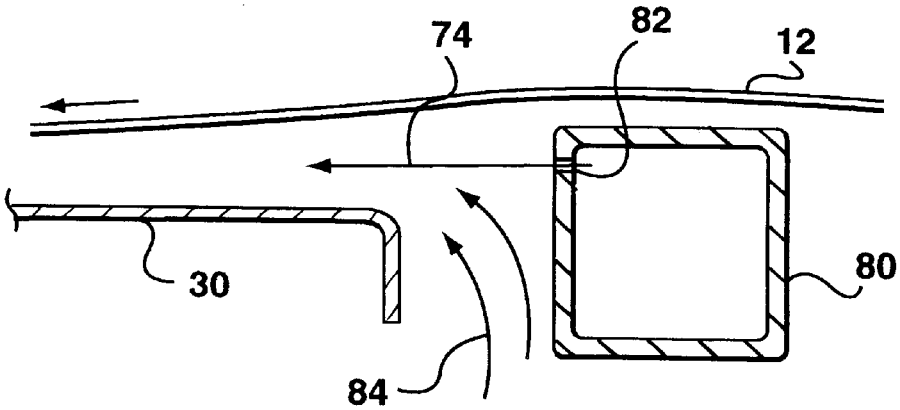

In FIG. 9, the air flow sources 50, 66, and 68 each comprise an elongate tube 80 that extends across the width of tray 44 to direct air stream 74 in a direction parallel to the paper tail travel 12 over the tray sections 30. The tube 80 has pressurized air that exits out of jet openings 82 spaced along the tube width. Additional entrained air flow is through the air gap 84 between sheet 30 and tube 80. Of course it will be readily appreciated by those skilled in the art that other types of air jets may be used to achieve the desired air flow pulling effect over the sheets 30 of the tray 44.

Figure 7:
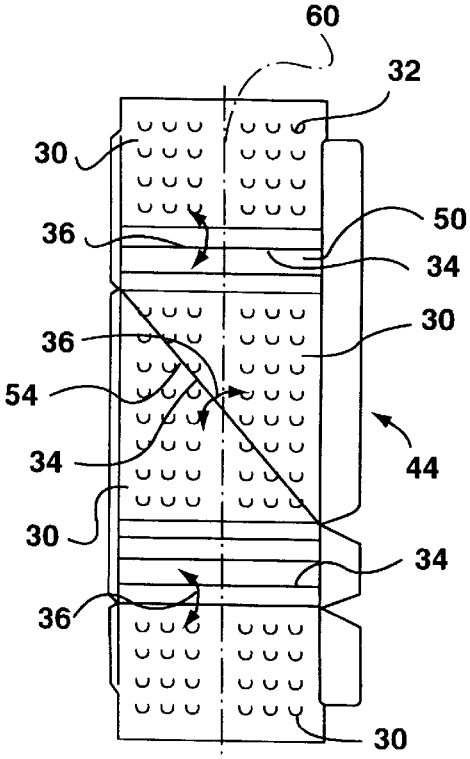
FIG. 7 is a front view showing an alternative tray embodiment where the tray has only one crease bisecting the longitudinal line of the tray at an angle other than 90 degrees.

The tray apparatus of the present invention provides the unique ability to alter or re-direct the path of paper tail travel irrespective of the paper weight, moisture content, speed or fiber make-up without folding the paper tail due to the creases 54 and 58 located in the tray 44. Thus the tray 44 maintains the integrity of the paper tail as it travels over the tray 44. While only the upstream crease 54 is required to introduce a lateral offset in the travel of the paper (as shown in FIG. 7), the downstream crease 58 typically re-orientates the paper travel in alignment with the direction of travel of the downstream threading nip 16. However, a downstream crease such as crease 86 could be utilized at the location of crease 58. Downstream crease 86, and similar lead-in crease 88 function to support the paper tail respectively over trailing surface 30 closely adjacent the threading nip 16 and lead in surface 30 closely adjacent the dryer section 14.

In the preferred embodiment shown, the creases 54 and 58 diverge from each from other when viewed extending from side 92 (FIG. 2). While it may be said that creases diverge from each other, they also appear to be converging on each other when viewed from side 94. However for the purpose of the present invention, these creases 54 and 56 are referred to as divergent. Each of the creases 54 and 56 are shown to bisect the longitudinal path line 60 extending between the ends 62 and 64 of tray 44 at an angle of about 45 degrees. It should be understood that in order to effect a lateral offset in the direction of paper tail travel, the bisecting angles 39, 41 (FIG. 2) of each crease must be other than 90 degrees. Further, the sum of the angles on either side of the bisection of the longitudinal path line 60 by either of creases 54 or 58 is 180 degrees, that is the straight line of the crease.

By folding the lead-in surface portion 46 relative to the intermediate surface portion 52 a lateral offset in the path of paper tail travel is accomplished. The angle of the folds 36 about crease 54 determines the displacement of the paper tail in the offset direction together with the length of the longitudinal path line 60 extending through the intermediate surface portion 52. The fold angle about crease 58 is also chosen to reorientate the paper tail 12 towards the threading nip. These angles of folds about creases 54 and 58 are pre-selected and are adjustable.

Figure 10:
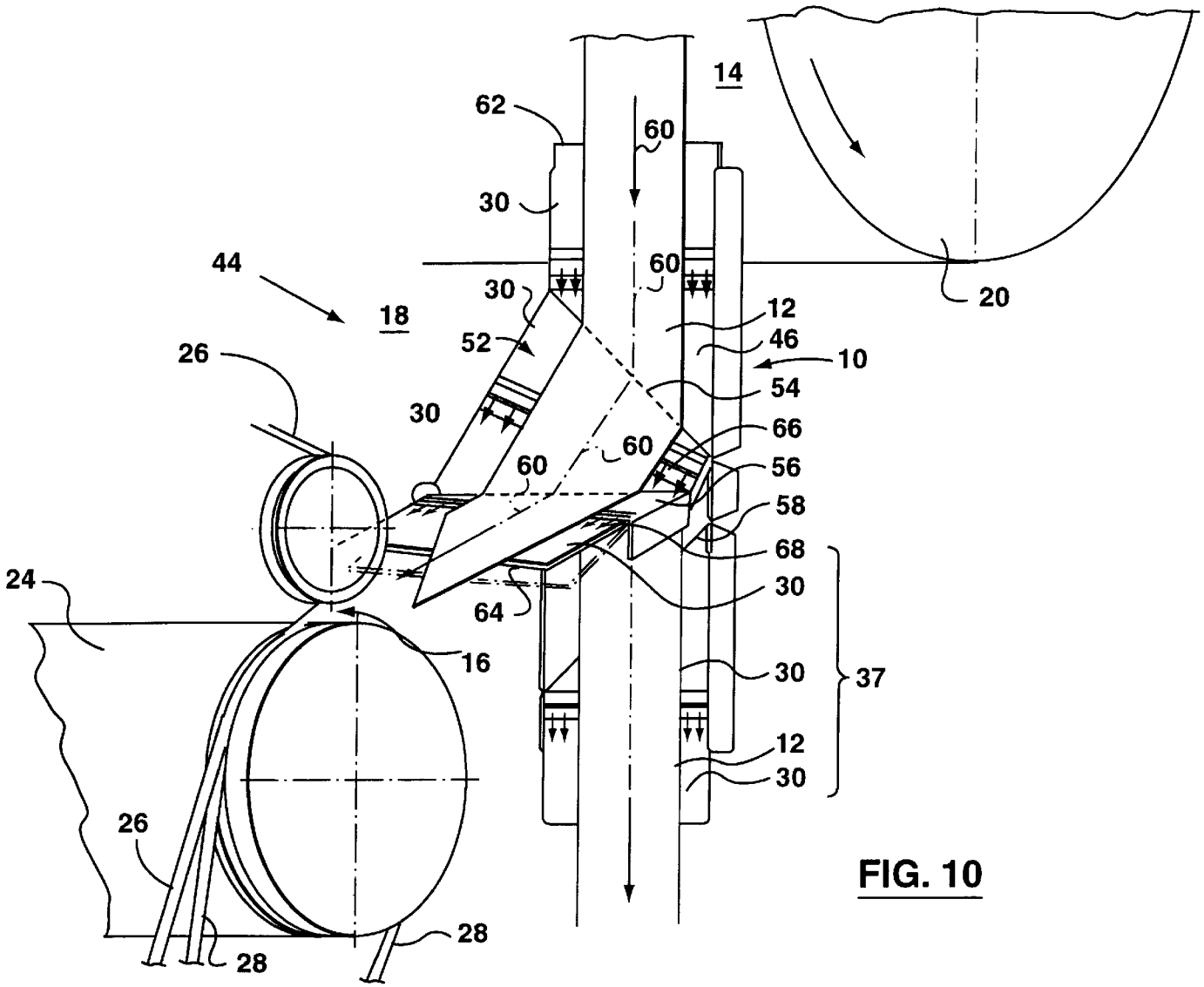
FIG. 10 illustrates an embodiment of the directional tail transfer apparatus of the present invention where the transfer apparatus transfers a tail; and, FIG. 11 illustrates an embodiment similar to FIG. 6 showing additional air flow sources extending across the creases of the tray.

In FIG. 10, a paper tail 12 is shown folded into the threaded rope nip 16 after the tail 12 is permitted to run over the tray 44. After some time interval, the tray 44 is adjusted from the retracted position 37 into the position shown to capture the tail 12 in the threaded nip 16. Other than this difference, FIG. 10 is substantially similar to FIG. 1.

Figure 11:
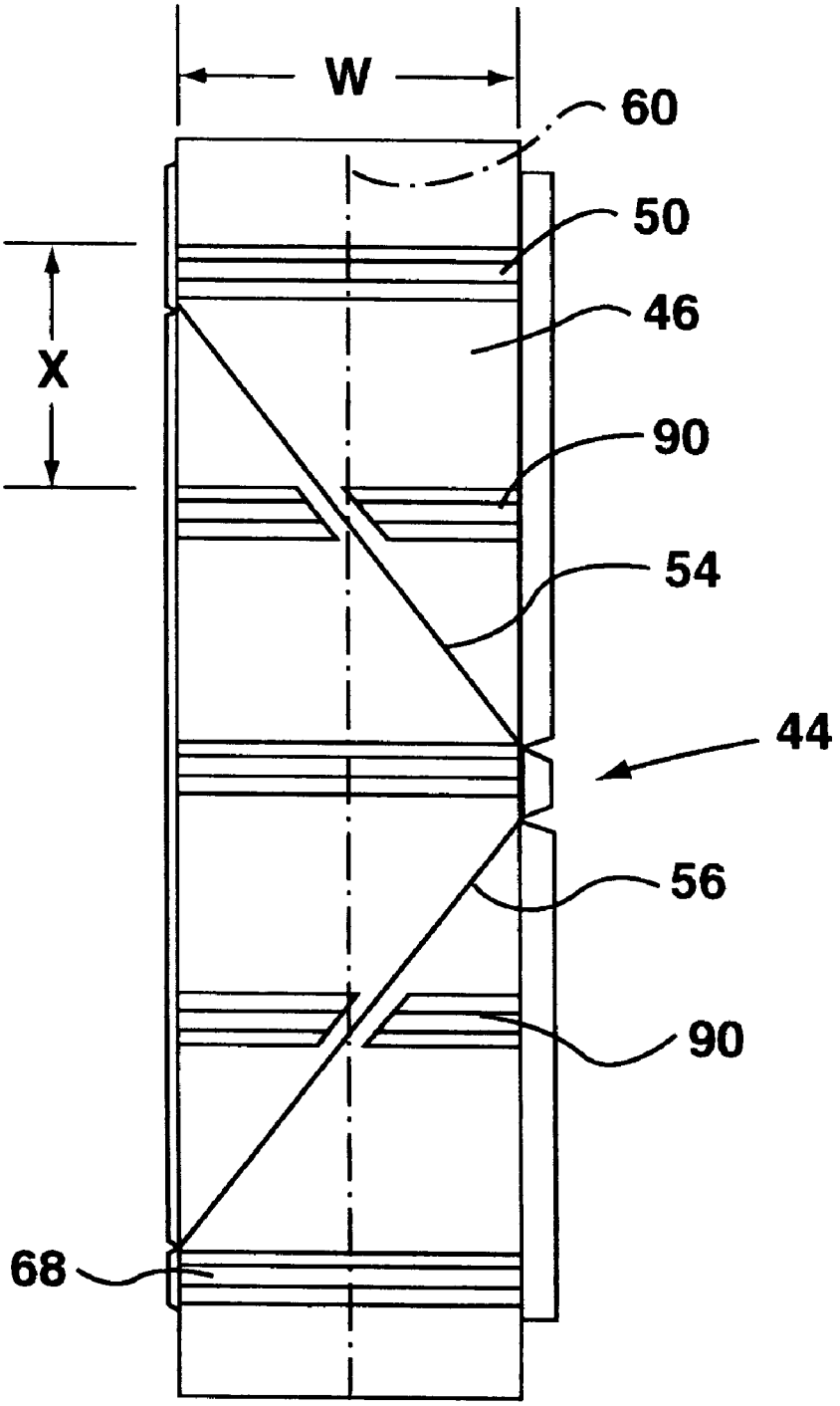

Referring to FIG. 11, there is shown an alternative embodiment for the tray 44 where additional air stream sources 90 are located across the creases 54 and 58. In FIG. 11, the distance X shown between air source 90 and air source 50 is dependent on the width of the tray W and the air flow speed required to hold the paper tail to the tray 44. This is also true of the distance between the air flow sources shown in FIGS. 6 and 7.

It will be understood that alternative embodiments to the preferred teachings made herein may be apparent to those skilled in the art, the scope of the present invention should not be restricted to the preferred embodiment and should be construed in accordance with the scope of the claims that follow.

What is claimed is:

1. A directional tail transfer apparatus for directing a tail of a web of flexible material from a first section of a machine to a threading nip of the machine where the threading nip is laterally offset from the initial path of movement of the tail exiting the first section; the directional paper tray transfer apparatus including:

a first air stream source located adjacent the first section for directing a first air stream in a first direction;

an adjustable tray positioned downstream of the first air stream source over and along which the first air stream flows to pull the tail in a predetermined path of travel along the tray; the tray having:

(i) a lead-in surface portion having a first end located adjacent the first air stream source for capturing the tail over the tray;

(ii) a trailing surface portion located downstream of the lead-in surface portion, and a first crease extending completely across the tray, the trailing surface portion having a second end adjacent the threading nip and upstream therefrom for directing the tail into the threading nip, and, (iii) a longitudinal path line defined by, and along which, the predetermined path of travel of the tail extends between the first and second ends of the tray, the first crease bisecting the longitudinal path line at a predetermined angle other than 90 degrees, and the longitudinal path line changing direction when the planar portions of the tray are adjusted relative to each other about the first crease for directional adjustment of the predetermined path of travel of the tail.

2. The directional tail transfer apparatus of claim 1 further including position control means for adjusting the tray between a retracted position where the tail continues to follow its normal path of travel and an operable tail re-directional position for capturing the tail and directing the tail into the threading nip.

3. The directional paper tail transfer apparatus of claim 2 wherein the tail runs past the adjustable tray prior to the tray being moved into the operable tail re-directional position.

4. The directional paper tail transfer apparatus of claim 1 wherein the tail is a chopped tail having a leader that is redirected by the paper tray into the threading nip.

5. The directional tail transfer apparatus of claim 1 wherein the lead-in surface portion and trailing surface portion of the tray are substantially planar extending surfaces.

6. The directional tail transfer apparatus of claim 1 wherein the trailing surface portion is adjusted relative to the lead-in surface portion about the first crease by a first pre-selected angle to introduce a first offset component to the longitudinal path line of the paper tray to direct the tail along the trailing surface portion in a second direction parallel to the longitudinal path line in the trailing surface portion.

7. The directional tail transfer apparatus of claim 1 wherein the first air stream source has a first velocity whose magnitude is greater than that of the tail exiting the first section.

8. The directional tail transfer apparatus of claim 1 wherein the first air stream source is one source selected from the group consisting of a series of air flow nozzles and a transverse air gap extending in a direction perpendicular to the initial path of tail travel such that the first air stream pulls and maintains integrity of the tail in a direction parallel to the longitudinal direction.

9. The directional tail transfer apparatus of claim 1 wherein a second air stream source is located downstream of the first air stream source to direct air over the trailing surface portion in a direction parallel to the longitudinal path line extending along the trailing surface portion.

10. The directional tail transfer apparatus of claim 9 wherein the magnitude of the velocity of the air flow increases with each air stream source located downstream in the direction of tail travel to continue to exert an increased pulling force on the tail.

11. The directional tail transfer apparatus of claim 1 wherein the sum of angles on either side of the bisection of the first crease through the longitudinal path line is 180 degrees.

12. The directional tail transfer apparatus of claim 1 wherein the tray comprises a rectangular sheet and the crease comprises a hinge joint.

13. The directional tail transfer apparatus of claim 1 wherein the tray is assembled from a rectangular sheet cut along the first crease into the lead-in surface portion and the trailing surface portion, the tray further including hinges attached along the first crease to allow the surface portions of the tray to be folded relative to each other.

14. The directional tail transfer apparatus of claim 1 wherein each of the surface portions of the tray has a dimpled surface.

15. A directional tail transfer apparatus for directing a tail of a web of flexible material from a first section of a machine to a threading nip of the machine where the threading nip is laterally offset from the initial path of movement of the tail exiting the first section; the directional paper tray transfer apparatus including:

a first air stream source located adjacent the first section for directing a first air stream in a first direction;

an adjustable tray positioned downstream of the first air stream source over and along which the air stream flows to pull the tail in a predetermined path of travel along the tray; the tray having:

(i) a lead-in surface portion having a first end located adjacent the first air stream source for capturing the tail over the tray;

(ii) an intermediate surface portion located downstream of the lead-in surface portion and separated therefrom by a first crease extending completely across the tray;

(iii) a trailing surface portion located downstream of the intermediate surface portion and separated therefrom by a second crease extending completely across the tray, the trailing surface portion having a second end adjacent the threading nip and upstream therefrom for directing the tail into the threading nip; and, (iv) a longitudinal path line defined by, and along which, the predetermined path of travel of the tail extends between the first and second ends of the tray, the first and second creases each bisecting the longitudinal path line where at least one of the first and second creases bisects the longitudinal path line at predetermined angles other than 90 degrees, and the longitudinal path line changing direction when the planar portions of the tray are adjusted relative to each other about the first and second creases for directional adjustment of the predetermined path of travel of the tail.

16. The directional tail transfer apparatus of claim 1 wherein the first and second creases diverge from each other.

17. The directional tail transfer apparatus of claim 15 further including position control means for adjusting the paper tray between a retracted position where the tail continues to follow its normal path of travel and an operable tail re-directional position for capturing the tail and directing the tail into the threading nip.

18. The directional paper tail transfer apparatus of claim 15 wherein the tail is running past the adjustable tray prior to the tray being moved the operable tail re-directional position.

19. The directional paper tail transfer apparatus of claim 15 wherein the tail is a chopped tail having a leader that is redirected by the paper tray into the threading nip.

20. The directional tail transfer apparatus of claim 15 wherein the lead-in surface portion, intermediate surface portion, and trailing surface portion of the tray are substantially planar extending surfaces.

21. The directional tail transfer apparatus of claim 20 wherein the intermediate surface portion is adjusted relative to the lead-in surface portion about the first crease by a first pre-selected angle to introduce a first offset component to the longitudinal path line of the tray for directing the tail along the intermediate surface portion in a second direction parallel to the longitudinal path line in the intermediate surface portion.

22. The directional tail transfer apparatus of claim 21 wherein the trailing surface portion is adjusted relative to the intermediate surface portion about the second crease by a second pre-selected angle to introduce a second offset component to the longitudinal path line of the paper tray to direct the tail along the trailing surface portion in a third direction parallel to the longitudinal path line in the trailing surface portion.

23. The directional tail transfer apparatus of claim 20 wherein the first air stream has a first velocity whose magnitude is greater than that of the tail exiting the first section.

24. The directional tail transfer apparatus of claim 20 wherein the first air stream source is a source selected from the group consisting of a series of air flow nozzles and an air gap extending in a direction perpendicular to the initial path of tail travel such that the first air stream pulls and maintains integrity of the tail in a direction parallel to the longitudinal direction and to the tray surface.

25. The directional tail transfer apparatus of claim 20 wherein second and third air stream sources are located respectively downstream of the first air stream source to direct air respectively over the intermediate surface portion and the trailing surface portion in directions parallel to the longitudinal path line extending along each of these portions.

26. The directional tail transfer apparatus of claim 25 wherein the magnitude of the velocity of the air flow increases with each air stream source located downstream in the direction of tail travel to continue to exert an increasing pulling force on the tail.

27. The directional tail transfer apparatus of claim 20 wherein the sum of angles on either side of the bisection of each of the first and second creases through the longitudinal path line is 180 degrees.

28. The directional tail transfer apparatus of claim 20 wherein the tray comprises a rectangular sheet and the first and second creases comprise a hinge joint.

29. The directional tail transfer apparatus of claim 20 wherein the tray is assembled from a rectangular sheet cut along the first and second creases into the lead-in surface portion, the intermediate surface portion, and the trailing surface portion, the tray further including hinges attached along the first and second creases to allow the surface portions of the tray to be folded relative to each other.

30. The directional tail transfer apparatus of claim 29 wherein each of the planar surface portions of the tray has a dimpled surface.

31. The directional tail transfer apparatus of claim 20 wherein each of the surface portions of the tray has a dimpled surface.

32. A paper making machine comprising:

a first section from which a paper tail travels in a direction of travel, a threading nip normally located downstream of and spaced offset from the direction of travel of the paper tail for capturing the paper tail and threading the paper tail into a second section, and a directional paper tail transfer apparatus for altering the direction of travel of a paper tail between the first section and the threading nip, said directional tail transfer apparatus comprising:

(a) a first air stream source located adjacent the first section for directing a first air stream in a first direction;

(b) an adjustable tray positioned downstream of the air stream source over and along which the air stream flows to pull the paper tail along the paper tray parallel to a longitudinal path line extending along the tray along and hold the paper tail close to surfaces of the tray, the paper tray apparatus having a first crease and a second crease positioned downstream of the first crease, the first and second creases extending completely across the paper tray apparatus and each bisecting the longitudinal path line; and at least the first crease bisecting the longitudinal path line at predetermined angles other than 90 degrees; the tray including:

(i) a lead-in planar surface portion located upstream of the first crease and downstream of the air stream source for capturing the paper tail and directing the paper tail along the lead-in planar surface in a first direction parallel to the longitudinal path line;

(ii) an intermediate planar surface portion located between the first and second creases and adapted to be adjusted relative to the lead-in planar surface portion about the first crease by a first pre-selected angle to introduce a first offset component to the tray for directing the paper tail along the intermediate planar surface portion in a second direction parallel to the longitudinal path line; and, (iii) a trailing planar surface portion located downstream from the second crease and adjusted relative to the intermediate planar surface portion about the second crease by a second pre-selected angle to introduce a second offset component to the paper tray to direct the paper tail along the trailing planar surface portion in a third direction parallel to the longitudinal path line and into the threading nip.

33. The papermaking machine of claim 32 further including position control means for adjusting the paper tray between a retracted position where the tail continues to follow its normal path of travel and an operable tail re-directional position for capturing the tail and directing the tail into the threading nip.

34. The papermaking machine of claim 33 wherein the tail is running past the adjustable tray prior to the tray being moved the operable tail re-directional position.

35. The papermaking machine of claim 32 wherein the tail is a chopped tail having leader that is redirected by the paper tray into the threading nip.

36. The papermaking machine of claim 35 wherein the trailing planar surface portion is adjusted relative to the intermediate planar surface portion about the second crease by a second pre-selected angle to introduce a second offset component to the longitudinal path line of the paper tray to direct the paper tail along the trailing planar surface portion in a third direction parallel to the longitudinal path line in the trailing planar surface portion.

37. The papermaking machine of claim 35 wherein the first air stream has a first velocity whose magnitude is greater than that of the paper tail exiting the first section.

38. The papermaking machine of claim 37 wherein the first air flow source is one selected from the group consisting of a series of air flow nozzles and an air gap extending in a direction perpendicular to the first direction of paper tail travel such that the first air stream pulls and maintains planar integrity of the paper tail.

39. The papermaking machine of claim 38 herein the sum of angles on either side of the bisection of each of the first and second creases through the longitudinal path line is 180 degrees.

40. The papermaking machine of claim 37 wherein second and third air stream sources are located respectively downstream of the first air stream source to direct air respectively over the intermediate surface portion and the trailing surface portion in directions parallel to the longitudinal path line extending along each of these portions.

41. The papermaking machine of claim 40 wherein the magnitude of the velocity of the air flow increases with each air stream source located downstream in the direction of paper tail travel to continue to exert a pulling force on the paper tail.

42. The papermaking machine of claim 40 wherein each of the planar surface portions of the tray has a dimpled surface.

43. The papermaking machine of claim 32 wherein the intermediate planar surface portion is adjusted relative to the lead-in planar surface portion about the first crease by a first pre-selected angle to introduce a first offset component to the longitudinal path line of the tray for directing the paper tail along the intermediate planar surface portion in a second direction parallel to the longitudinal path line in the intermediate planar surface portion.

44. The papermaking machine of claim 32 wherein the tray comprises a rectangular sheet and the first and second creases comprise a hinge joint.

45. The papermaking machine of claim 32 wherein the tray is assembled from a rectangular sheet cut along the first and second creases into the lead-in planar surface portion, the intermediate planar surface portion, and the trailing planar surface portion, the tray further including hinges attached along the first and second creases to allow the planar surface portions of the tray to be folded relative to each other.

46. The papermaking machine of claim 32 wherein each of the planar surface portions of the tray has a dimpled surface.

* * * * *